United States Patent [19]

Kretchman et al.

[11] Patent Number: 4,908,959

[45] Date of Patent: Mar. 20, 1990

[54] AIRFLOW DIRECTING DRY RACK

[75] Inventors: Gerald L. Kretchman, Joseph Township, Berrien County; James I. Czech, Lincoln Township, Berrien County both of Mich.

[73] Assignee: Whirlpool Corporation, Benton Harbor, Mich.

[21] Appl. No.: 253,599

[22] Filed: Oct. 5, 1988

[51] Int. Cl.[4] ..... F26B 19/00

[52] U.S. Cl. ..... 34/133; 34/195; 34/104; 34/151

[58] Field of Search ..... 34/133, 197, 202, 104, 34/195

[56] References Cited

U.S. PATENT DOCUMENTS

| | | | |
|---|---|---|---|
| 2,617,203 | 11/1952 | Murray . | |
| 2,628,432 | 2/1953 | Morrison . | |
| 3,316,659 | 5/1967 | Lauck . | |
| 3,344,532 | 10/1967 | Bigler . | |
| 4,091,548 | 5/1978 | Daily | 34/133 |

OTHER PUBLICATIONS

Whirlpool Advertising Brochure Literature–p. 13.

*Primary Examiner*—Henry A. Bennet

*Attorney, Agent, or Firm*—Hill, Van Santen, Steadman & Simpson

[57] ABSTRACT

A dry rack for an axial flow dryer including a channel formed beneath the dry rack upper gridwork panel to direct airflow downward through the gridwork and out through the dryer exhaust opening. The channel is formed by side and back panels depending downwardly from the upper gridwork panel and a plate forming a floor and attached along bottom edges of the downwardly depending panels. Front edges of the side panels and the bottom plate abut against and surround the exhaust opening so as to force the channeling of exhaust air first through the upper gridwork panel and then out through the exhaust opening. For attaching the dry rack through the bottom edge of a doorway of the dryer, there is included a rectangular slide member panel that extends into a lint screen slot formed within a grill located within the exhaust opening and that engages support flanges therein to assist in supporting the dry rack from the exhaust opening.

14 Claims, 3 Drawing Sheets

AIRFLOW DIRECTING DRY RACK

BACKGROUND OF THE INVENTION

The present invention relates generally to dry racks for axial flow dryers having rotating drums or baskets and, specifically, to a dry rack for directing airflow through the gridwork of the dry rack and then out through an exhaust opening.

Many dryers manufactured today are of the axial airflow type with a rotating basket or drum having an axis of rotation oriented perpendicularly to the front of the dryer and wherein articles such as clothing and the like are tumbled and tossed about while hot air is passed trough the basket or drum to dry the articles. These dryers have a doorway or a opening on a front face thereof for loading and unloading of the articles. A door hinged on the bottom or side, swings or flips to close and open the doorway or opening.

Axial flow dries obtain their designation due to the nature of the low of air within the drum or basket thereof. Air, usually heated, is first caused to enter the drum or basket of a dryer through a stationary or rotational back panel at one axial end of the drum or basket. The air is then caused to flow along the axis of the drum or basket past and through the articles to be dried. Finally, the air is caused to exit through an exhaust opening located on an edge of the doorway or opening of the dryer. Thus, the air can be said to flow axially through the dryer.

Many times it is desirable to dry articles without having them be tossed or tumbled. For example, sweaters or shirts made of delicate fabrics are laid out and allowed to dry flat. Additionally, other articles such as canvas tennis shoes, when placed in a rotating basket, tumble about causing loud banging noises and do not necessarily dry in the most efficient manner in a rotating basket or drum.

To take advantage of the faster drying of articles provided by dryers and yet to prevent damage caused by tumbling or tossing, dry racks have been provided for such dryers. The dry racks provide a flat surface upon which the articles may be placed and be subjected to heated airflow and yet not be tossed or tumbled about.

Generally, the dry racks include a gridwork panel which is positioned substantially horizontally within the rotating basket, one end of the dry rack being attached to or near the doorway or opening of the dryer (or both ends, also). Articles placed on the dry rack are subjected to heated airflow as the heated air flows axially through the basket or drum and out through an exhaust located either out the bottom of the opening or through a door covering the opening.

One problem associated with such dry racks is that they do not ensure that there is an adequate airflow directed past or through the articles located on the gridwork. The air may flow axially past or around the articles and out the exhaust without efficiently extracting moisture from the articles. Additionally, there is no assurance that the air will flow near where the articles are located.

SUMMARY OF THE INVENTION

The present invention provides a dry rack for an axial flow dryer that directs heated airflow past and through articles placed on the gridwork of the dry rack and through the gridwork. To this end, a dry rack for an axial flow dryer is provided with a channel formed beneath an upper gridwork panel that channels and directs all of the exhaust air through the upper gridwork and out through the exhaust opening of a dryer having an exhaust opening located at the bottom edge of the dryer doorway or opening. The channel is formed by panels that depend downwardly from lateral and back edges of the upper gridwork panel and a bottom plate attached along bottom edges of the downwardly depending panels. The front edge of the upper gridwork panel is attached to or near the bottom edge of the doorway or opening. The front edges of the panels depending downwardly from the lateral edges of the upper gridwork panel and the front edge of the bottom plate surround the exhaust opening to force the airflow to be directed first through the gridwork and then out through the exhaust opening.

DETAILED DESCRIPTION OF THE PREFERRED EMBODIMENT

Figure 1:
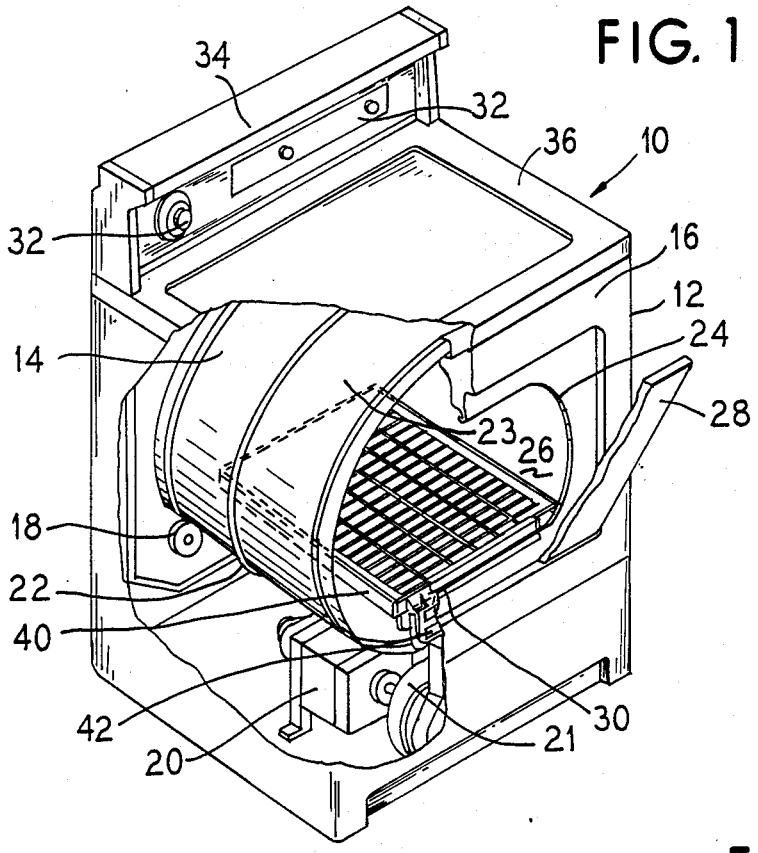
FIG. 1 is a perspective view of an axial flow dryer having located therein a dry rack incorporating the principles of the invention.

An axial flow dryer 10 is illustrated in FIG. 1. The dryer includes a cabinet 12 having located therein a rotating basket or drum 14 the longitudinal axis of which is oriented perpendicularly to a front face 16 of the dryer cabinet 12. The basket or drum 14 is supported by and rotated upon rollers 18 and driven by a motor 20 through the use of a drive belt 22. The basket or drum 14 includes axial ribs, not shown, along the interior wall thereof to cause articles placed within the basket or drum 14 to be tossed or tumbled about.

A blower 21, also driven by the motor 20, provides an airflow to the drum or basket 14. The air of the airflow is heated by a heater not shown in the drawings. The heated airflow is introduced into the interior of the drum or basket through a porous stationary or rotating back panel 23 located at the rear axial end of the drum or basket 14.

The front face 16 of the dryer 10 includes an opening or doorway 24 through which articles to be dried can be placed into or removed from the interior 26 of the basket or drum. A door 28 hinged along an edge 30 of the doorway 24 seals the doorway 24 when the dryer 10 is in operation.

A variety of controls 32 are located on a control panel 34 positioned on a top side 36 of the dryer 10.

As is further illustrated in FIG. 1, a dry rack 40 embodying principles of the invention is attached to the bottom edge 30 of the doorway or opening 24. As will be more specifically described below, the dry rack 40 engages an exhaust opening 42 situated at the bottom edge 30 of the doorway or opening 24 in the dryer 10. So engaged, the dry rack 40 is positioned substantially horizontally within the rotating basket or drum 14. As explained further below, the dry rack 40 is so designed that when initially placed unloaded within the drum or basket 14, the dry rack 40 is angled upwardly toward the rear so that when fully loaded, the dry rack 40 attains a horizontal position. In the horizontal position, there remains a clearance between the dry rack 40 and the ribs of the drum or basket 14. Any lint screen is removed from the exhaust opening 42 before the dry rack 40 is placed in the dryer 10.

As can be appreciated, the dry rack 40 remains stationary while the basket or drum 14 rotates. The dry rack 40 is ideal for articles that may be damaged if they are tumbled or tossed about in a dryer, such as sweaters made of delicate fabrics. Such articles can be laid upon the dry rack 40 and be subjected to the flow of hot air produced by the dryer 10, yet not be tumbled or tossed about.

Figure 2:
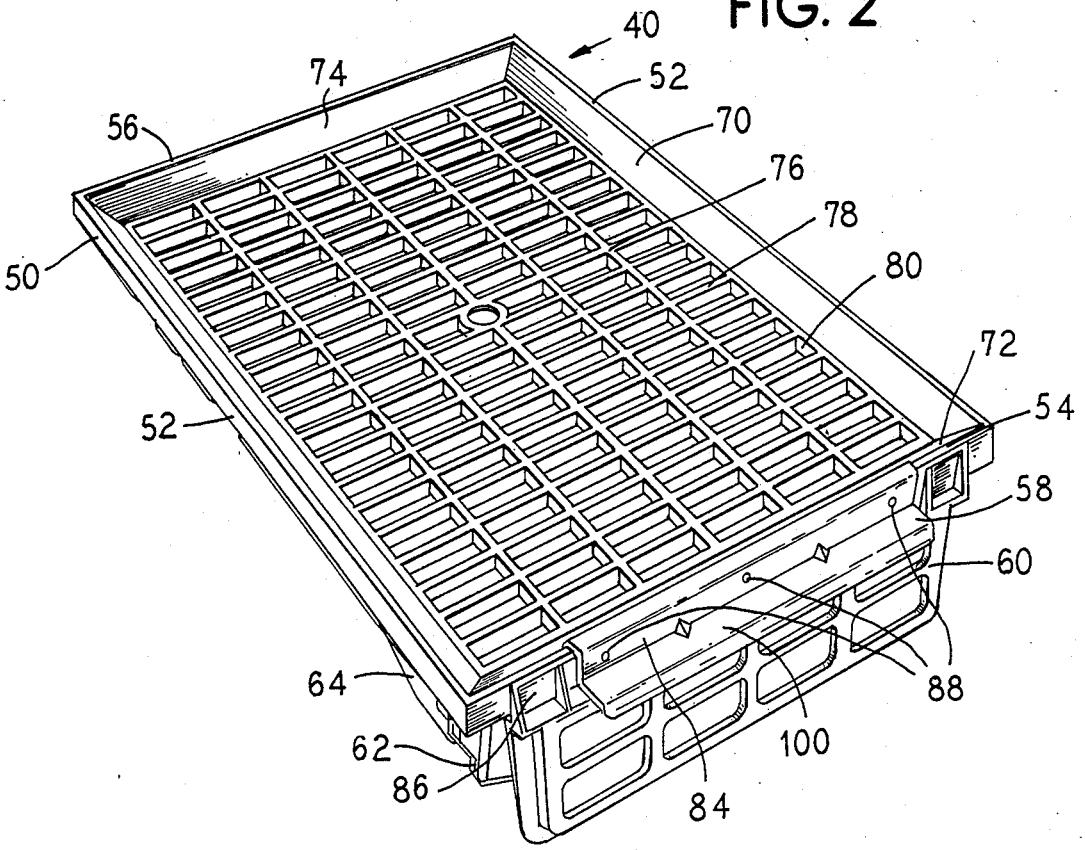
FIG. 2 is a perspective view of a dry rack embodying principles of the invention.

In FIG. 2 the dry rack 40 is illustrated further, in perspective view. The dry rack 40 includes a porous support panel in the form of an upper gridwork panel 50, upon which the articles for drying are placed, and has lateral edges 52, front edge 54, and back edge 56; a support plate 58 attached along the front edge 54 for engaging the bottom edge 30 of the dryer doorway 24 to support the dry rack 40 therefrom; a slide member 60 that is inserted into the exhaust opening 42 to assist in supporting the dry rack 40 from the exhaust opening 42; and a bottom plate 62, barely visible in FIG. 2, attached along bottom edges of downwardly depending side panels 64 that together form a channel or conduit that directs the airflow through upper gridwork panel 50 and out through the exhaust opening 42.

The lateral edges 52, front edge 54, and back edge 56 of the upper gridwork panel 50 include sloped interior walls 70, 72, and 74, respectively. These sloped walls 70, 72, and 74 assist in retaining articles on the upper gridwork panel 50 and in directing airflow through gridwork portion 76 due to the slight square funnel shape produced.

Figure 3:
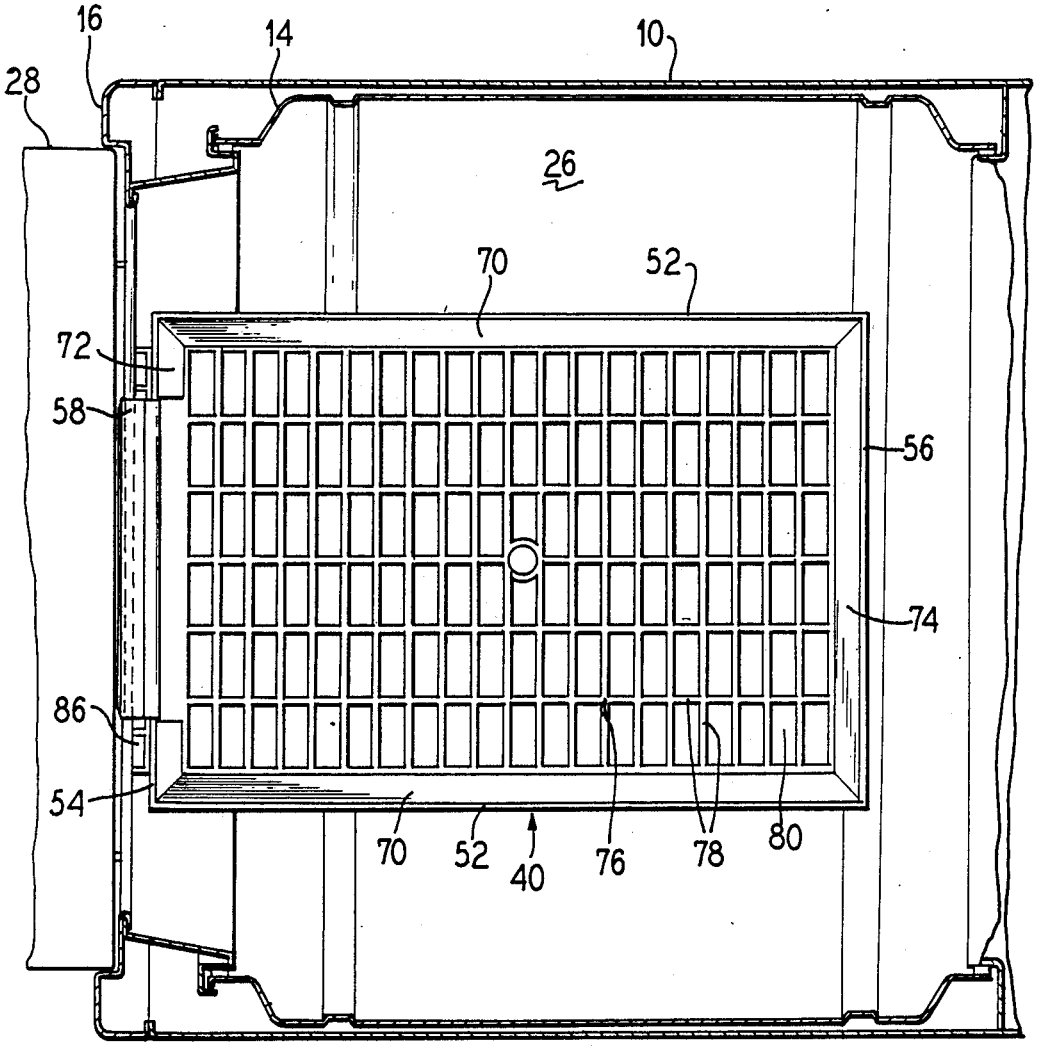
FIG. 3 is a top view of the dryer partially broken away showing the upper gridwork of the dry rack of FIG. 2.

As illustrated in FIGS. 2 and 3, the gridwork 76 of the upper gridwork panel 50 includes a plurality of perpendicularly oriented bars 78 defining a plurality of openings 80. It can be appreciated that although the gridwork 76 is shown as forming a plurality of rectangular openings 80, any type of gridwork or screen-like surface can be utilized so long as a sufficient amount of air is permitted to flow through the gridwork or screen-like surface. For example, the gridwork can include circular openings instead.

Figure 4:
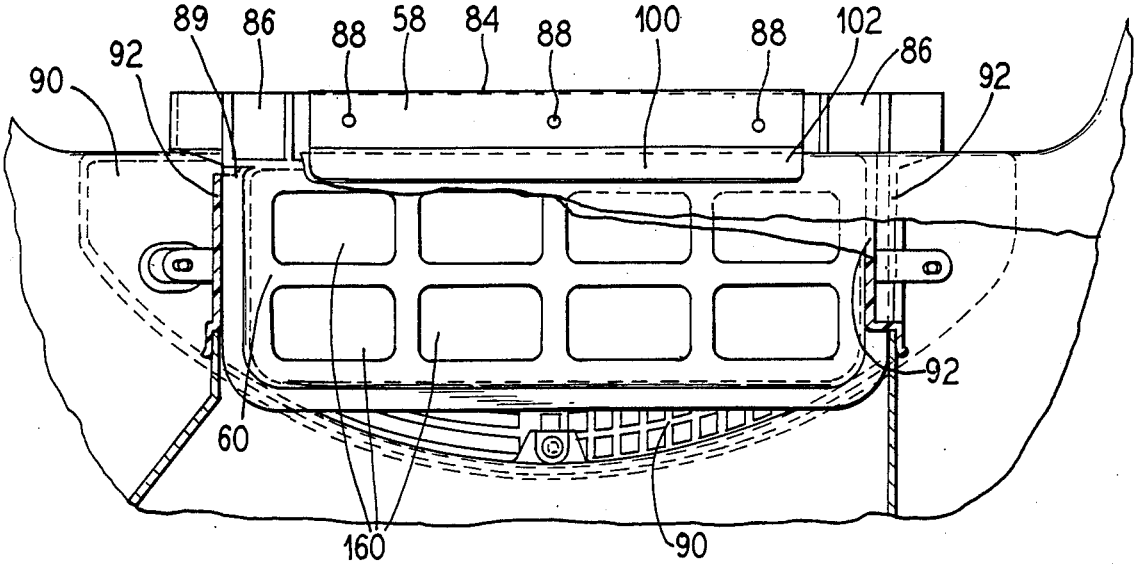
FIG. 4 is a front view partially broken away of the dryer of FIG. 1 showing the positioning of the slide of the dry rack of FIG. 2 within a grill of the exhaust opening of the dryer.
Figure 5:
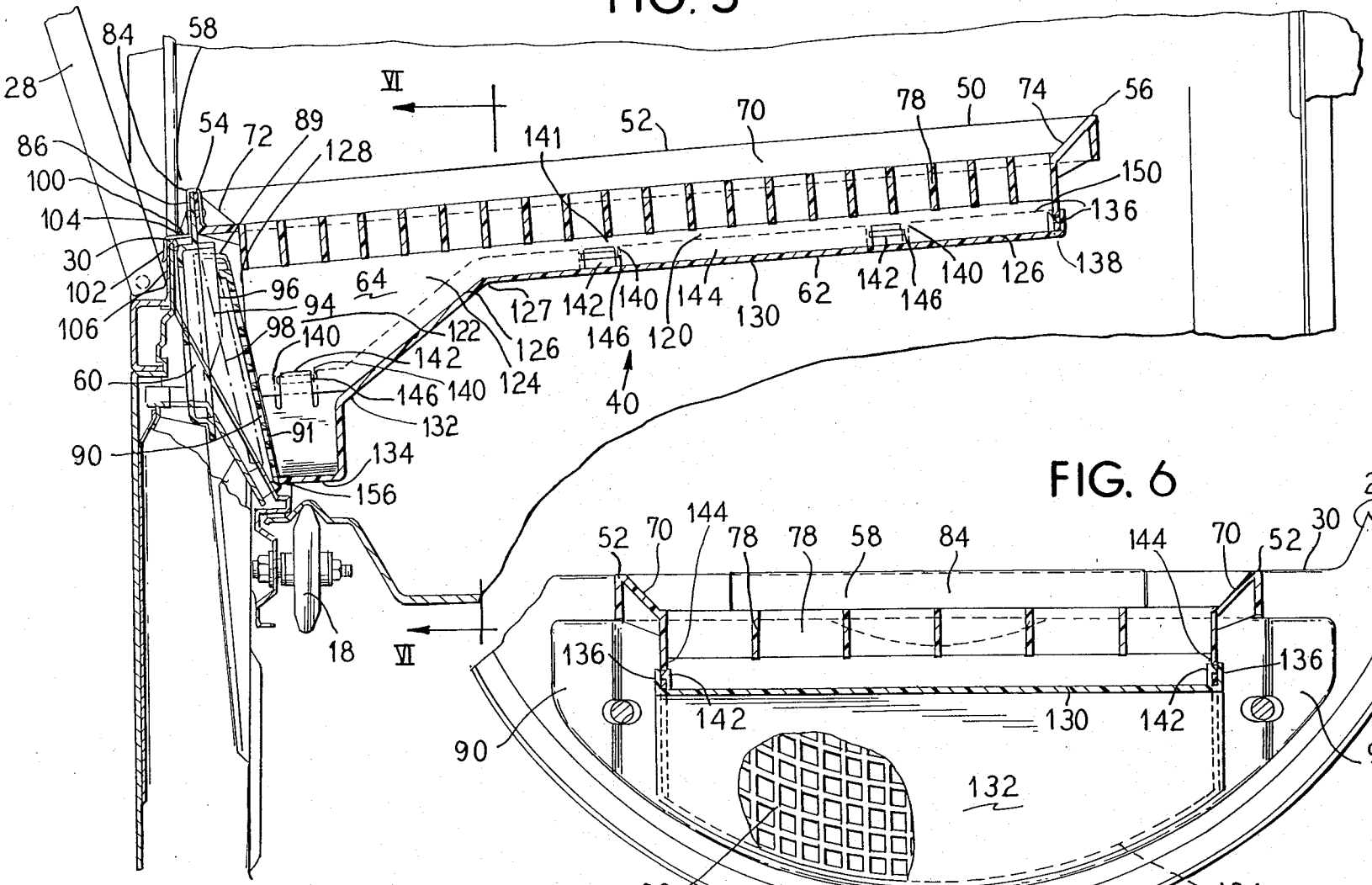
FIG. 5 is a side view of the dryer partially broken away showing the positioning of the dry rack of FIG. 2 within the dryer of FIG. 1.

The support plate 58 and slide member 60 are both attached along the front edge 54 of the upper gridwork panel 50, the slide member 60 depending downwardly therefrom. This is best illustrated in FIGS. 2, 4, and 5. In the preferred embodiment, the support plate 58 includes a clip portion 84 that fits over the front edge 54 and a top flange 86 of slide member 60, capturing both. Three rivets 88 secure the slide member top flange 86 and the upper gridwork panel front edge 54 within the clip portion 84.

As illustrated in FIG. 4, the slide member 60 is inserted within a slot 89 formed by a grill 90 located within the exhaust opening 42. In FIG. 4 there is illustrated the backside of the grill 90. The grill 90 attaches to the backside of the front face 16 of the dryer 10 within the exhaust opening 42.

The grill 90 located within the exhaust opening includes two pairs of support flanges 92 that are located on each side of the grill 90 and that are oriented perpendicularly to a plane defined by the grill 90. The support flanges 92 form lint screen tracks that cooperate with a lint screen, not shown, to secure same within the slot 89. The support flanges 92 extend toward the backside of the front face 16 of the dryer 10.

Each pair of support flanges 92 also cooperates with a support flange 94 extending from a backside 96 of the slide member 60 along each of the sides thereof to secure the slide member 60 within the slot 89. The support flanges 94 located on the backside 96 of the slide member 60 are illustrated most clearly in FIG. 5. It can be appreciated that each of the support flanges 94 located on the slide member 60 slides and engages between a pair of support flanges 92 located on the grill 90. This serves to correctly position the dry rack 40 within the basket or drum 14 and serves as additional support for the dry rack 40 which is thus mounted in a cantilevered fashion within the dryer drum.

As further illustrated in FIG. 5, the support flanges 94 located on the backside 96 of the slide member 60 are tapered along an edge 98 thereto to assist in inserting the support flanges 94 between the supporting flanges 92 located on the grill 90.

Also clearly illustrated in FIG. 5 is the engagement between the support plate 58 and the bottom edge 30 of the doorway opening 24. As can be seen, the support plate 58 includes the clip portion 84 that attaches to the front edge 54 of the upper gridwork panel 50 and a double L-bend portion 100 extending therefrom that includes a downwardly depending leg portion 102 and a spacer portion 104. The downwardly depending leg portion 102 engages a front side 106 of the bottom edge 30 of the opening or doorway 24 of the dryer 10. The spacer portion 104 assures that there is proper distance between the downwardly depending leg portion 102 to accommodate the slide member 60 width so that the slide member 60 can be inserted down through the slot 89 in the grill 90, and to hang the dry rack 40 from the edge 30 in cantilever fashion.

In the side view of the dry rack 40 illustrated in FIG. 5, the downwardly depending side panels 64 that extend downward from the lateral edges 52 of the upper gridwork panel 50 can be seen most clearly. There are two side panels 64 that are identical and that are located on opposite lateral edges of the upper gridwork panel 50. Each downwardly depending side pane 64 includes a relatively shorter portion 120, a relatively taller portion 122, and an angled or sloping portion 124 located therebetween.

The relatively shorter portion 120 extends from the back edge 56 of the upper gridwork panel 50 along a portion of the way towards the front edge 54. A bottom edge 126 of the side panel 64 along the relatively shorter portion 120 runs parallel to a plane defined by the upper gridwork panel 50. From a point 127 where the relatively shorter portion 120 ends, the bottom edge 126 of each downwardly depending side panel 64 is angled downward to form the angled portion 124. Prior to reaching a front edge 128 of the side panel 64, the bottom edge 126 again runs parallel to the plane defined by the upper gridwork panel 50 to form the relatively taller portion 122.

Figure 6:
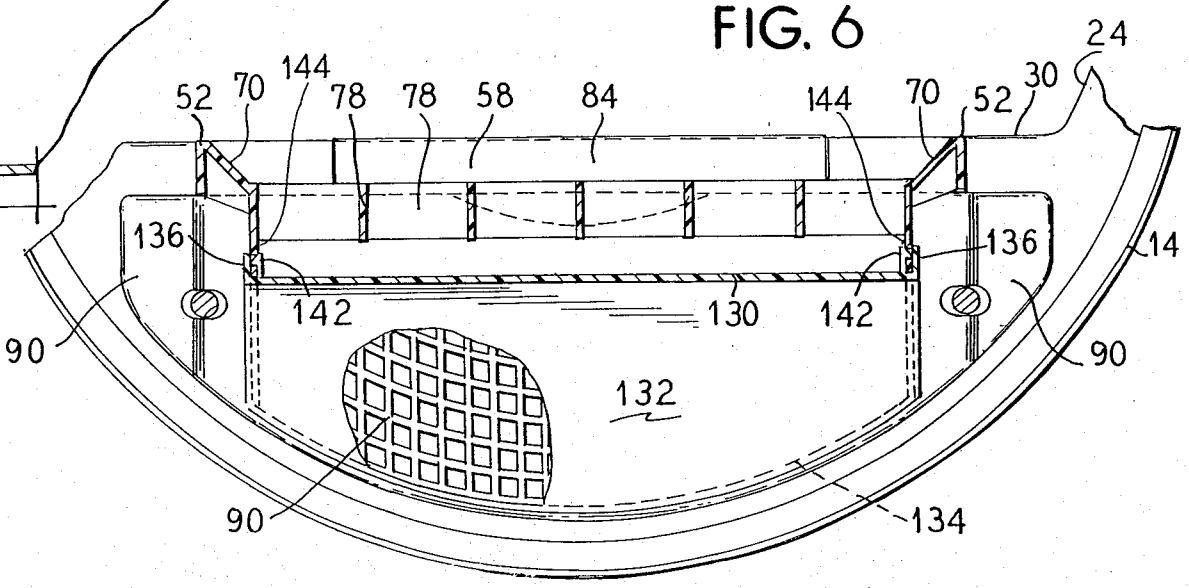
FIG. 6 is a cross-sectional view of the dry rack of FIG. 5 taken along the line VI—VI.

Also illustrated in FIG. 5, in addition to FIG. 6, is the bottom plate 62 of the dry rack 40, including its profile and the manner in which it is attached along the bottom edges 126 of the downwardly depending side panels 64. As illustrated, the bottom plate 62 includes flat portions 130 and 132 that extend between the downwardly depending side panels 64 and that follow the contour defined by the bottom edges 126 of the side panels 64 along the relatively shorter portions 120 and angled portions 124. Additionally, the bottom plate 62 includes a semi-circular portion 134 that extends below the relatively taller portions 122 of the side panels 64.

The bottom plate 22 further includes a relatively short upstanding edge 136 along its side edges 138. This short upstanding edge 136 engages the outside surfaces 141 of the downwardly depending side panels 64. As can be seen in FIG. 5, the short upstanding edge 136 includes cut-out portions 140 at selected locations therealong, at which there are included snap clips 142 that engage slotted openings 146 from an interior surface 144 of the side panels 64. Thus, the bottom plate 62 is attached to the downwardly depending side panels 64 by means of the snap clips extending from the interior surface 144 of the side panels through the slotted openings 146 therein.

Additionally, a back panel 150 depends downwardly from the back edge 56 of the upper gridwork panel 50. The back panel 150 has a height equal to the height of the relatively shorter side panel portions 120 and serves to form a wall at one end of the bottom plate 62. As illustrated, the bottom plate 62 is also secured to the back panel 150 by means of snap clips 142.

It can be appreciated that once the dry rack 40 has been assembled, below the upper gridwork panel 50, there is formed an enclosed space, formed by the downwardly depending side panels 64, the downwardly depending back panel 150, and the bottom plate 62. The front edge 156 of the bottom plate 62 engages and cooperates with the back surface of the interior wall of the front face 16 of the dryer 10 to preclude entry of airflow into the exhaust opening 42. Thus, all of the air that is to exit through the exhaust opening 42 must go through the channel or conduit formed beneath the upper gridwork panel 50. Therefore, the dry rack 40, as assembled, effectively directs airflow from the interior 26 of the basket or drum 14 downwardly through the upper gridwork panel 50, through the channel formed therebeneath and then out through the exhaust opening 42. This direction of the airflow ensures that there is airflow through or past articles placed upon the dry rack 40.

Additionally, the front edge 156 serves to support the dry rack 40 against a surface 91 of the grill 90 in cantilevered fashion. The front edge 156 abuts against, the surface 91 while the support plate 58 grips the bottom edge 30 of the doorway or opening 24. When the dry rack 40 is centrally placed within the drum or basket 14, it is slightly angled upwardly toward the back edge 56 by the gripping of the support plate 58. As the dry rack 40 is loaded, it settles down and the front edge 156 engages the surface 91 of the grill 90. Thus, the grill 90 serves to support the loaded weight of the dry rack 40.

As illustrated in FIG. 4, the slide member 60 includes a plurality of openings 160 formed herein: so that airflow through the exhaust opening 42 is not hindered. Because the slide member 60 is inserted behind the grid 90 located within the exhaust opening 42, if it were solid, exhaust air would not be permitted to pass through the grill 90. Therefore, the openings 160 are included to allow exhaust air to flow through the exhaust opening 42 grill 90 and out through the exhaust air conduit, not shown.

Due to the nature of the design on the dry rack 40, it is easily formed and assembled with minimal labor and parts. The upper gridwork panel 50 and bottom plate 62, and slide member 60 are readily formed by injection molding glass filled polypropylene. The support plate 58 is readily made of steel having a tensile strength of 790 MPA, bent to shape. In attaching the various components together, the upper gridwork panel 50 and slide member 60 are secured together by simply positioning the top flange 86 of the side member 60 along the front edge 54 of the upper gridwork panel 50, clipping clip portion 84 of the support plate 58 thereover, and then riveting the three components together with the three rivets 88. The bottom plate 62 is attached by simply snapping it in place along the bottom edges of the back and side panels 150 and 64, respectively. Once assembled, the dry rack is placed with the dryer 10 by simply inserting the slide member 60 within the lint screen slot 89 in the grill 90.

While a preferred embodiment has been shown, modifications and changes may become apparent to those skilled in the art which shall fall within the spirit and scope of the invention. It is intended that such modifications and changes be covered by the attached claims.

The embodiment of the invention in which an exclusive property or privilege is claimed are defined as follows:

1. A dry rack for a dryer having a rotatable dryer drum for receipt of materials to be dried by an airflow entering said drum at an inlet and exiting at an exhaust opening said dryer having a closable opening providing access to an interior of said drum, said dry rack comprising:

a porous support panel;

means for securing said panel in a stationary manner within said interior of said dryer drum and adjacent said exhaust opening; and means for directing at least a portion of said airflow within said drum through said panel, said means for directing said airflow comprising a channel formed on said dry rack which provides a closed communication path between said support panel and said airflow exhaust opening.

2. A dry rack as set forth in claim 1, wherein said dry rack comprises a box-like structure wherein said porous support panel comprises a top wall, three side walls and a bottom wall are non-porous and one side wall has an opening communicating with said exhaust opening.

3. A dry rack as set forth in claim 2, including a slide member attached along a front edge of said support panel and depending downwardly therefrom, said slide member adapted to be inserted into and to engage a slot formed in said exhaust opening.

4. A dry rack as set forth in claim 2, wherein said slide member further includes a plurality of openings formed therein to permit flow of exhaust air therethrough.

5. A dry rack as set forth in claim 4, wherein said bottom panel is formed as a separate member from said side walls and attaches to said side walls by a snap connection.

6. A dry rack as set forth in claim 5, wherein said snap connection comprises a plurality of upstanding tabs formed on said bottom wall which engage in openings formed on said side walls.

7. A dry rack as set forth in claim 1, wherein said channel directs substantially all of said airflow through said support channel and to said airflow exhaust opening.

8. A dry rack for an axial flow dryer having a rotatable dryer drum for receipt of materials to be dried by an airflow entering said drum at an inlet in a rear side of said drum and exiting said drum through an exhaust opening at a front side of said drum, said dryer further including a closable doorway providing access to an interior of said drum at said front side, said dry rack comprising:

an upper panel having lateral edges and being adapted to be positioned substantially horizontally within said basket and having a plurality of openings therein forming a grid-like surface;

a pair of side panels depending downwardly from said lateral edges of said upper panel;

a back panel depending downwardly from a back edge of said upper panel;

means for attaching said upper panel to said exhaust opening at a front edge of said panel so that said upper panel is retained in a substantially horizontal position within said drum; and a bottom plate attached to bottom edges of said downwardly depending side and back panels to form a channel beneath said upper panel being in communication with said exhaust openings to direct airflow downward through said openings in said upper panel and out through said exhaust opening.

9. A dry rack as set forth in claim 8, wherein said means for attaching said dry rack to said exhaust opening includes a rectangular slide member panel attached along said front edge of said upper panel and depending downwardly therefrom, said slide member being adapted to be received within and to engage a slot within said exhaust opening.

10. A dry rack as set forth in claim 8, wherein said means for attaching said upper panel to said exhaust opening includes a support plate attached along said front edge of the upper panel that includes a clip portion that overhangs said front edge of said upper panel and an L-bend portion that extends at a right angle therefrom and having a downwardly depending leg that engages along an edge of said doorway.

11. A dry rack as set forth in claim 8, wherein said slide member further includes a plurality of openings formed therein to permit flow of exhaust air therethrough.

12. A dry rack for an axial flow dryer as set forth in claim 8, wherein said side panels are identical in shape and include a relatively shorter back portion and a relatively taller forward portion and a sloping portion located therebetween.

13. A dry rack as set forth in claim 8, wherein said bottom panel is formed as a separate member from said side walls and attaches to said side walls by a snap connection.

14. A dry rack as set forth in claim 8, wherein said snap connection comprises a plurality of upstanding tabs formed on said bottom wall which engage in openings formed on said side walls.

* * * * *